US009440325B2

(12) United States Patent
Smith et al.

(10) Patent No.: US 9,440,325 B2
(45) Date of Patent: Sep. 13, 2016

(54) ADAPTABLE ABRASIVE CUTTING ASSEMBLY FOR SHARPENER

(71) Applicants: Richard S Smith, Hot Springs, AR (US); Louis P. Chalfant, Hot Springs, AR (US)

(72) Inventors: Richard S Smith, Hot Springs, AR (US); Louis P. Chalfant, Hot Springs, AR (US)

(73) Assignee: Smith's Consumer Products, Inc., Hot Springs, AR (US)

( * ) Notice: Subject to any disclaimer, the term of this patent is extended or adjusted under 35 U.S.C. 154(b) by 0 days.

(21) Appl. No.: 14/088,916

(22) Filed: Nov. 25, 2013

(65) Prior Publication Data

US 2015/0147945 A1 May 28, 2015

(51) Int. Cl.

| | |
|---|---|
| ***B24B 3/54*** | (2006.01) |
| ***B24B 3/40*** | (2006.01) |
| ***B24B 49/16*** | (2006.01) |
| ***B24B 47/10*** | (2006.01) |

(52) U.S. Cl.
CPC ..... *B24B 3/40* (2013.01); *B24B 47/10* (2013.01); *B24B 49/16* (2013.01)

(58) Field of Classification Search
CPC ..... B24B 3/54; B24B 1/00
USPC ..... 451/241, 267, 282, 45, 545, 549, 260, 451/261, 266, 293, 349; 76/82, 85, 88, 89
See application file for complete search history.

(56) References Cited

U.S. PATENT DOCUMENTS

| | | | | |
|---|---|---|---|---|
| 6,012,971 | A * | 1/2000 | Friel et al. | 451/45 |
| 6,875,093 | B2 * | 4/2005 | Friel et al. | 451/260 |
| 2011/0244767 | A1 * | 10/2011 | Elek et al. | 451/293 |

* cited by examiner

*Primary Examiner* — Robert Rose

(57) ABSTRACT

An electric sharpener having a pair of abrasive wheel assemblies including energy absorbing hubs mounted a powered drive shaft and further integral flexible radially extending arms affixed to respective outer abrasive rings. A pair of disk abrasives assemblies are also affixed to the powered rotatable shaft and include a pair of flexible metal disks operatively connected to a hub attached to the rotatable shaft.

6 Claims, 3 Drawing Sheets

ADAPTABLE ABRASIVE CUTTING ASSEMBLY FOR SHARPENER

BACKGROUND OF THE INVENTION

1. Field of the Invention

This invention relates to abrasive sharpeners, and more particularly, to an electric abrasive sharpener having adaptable flexible abrasive assemblies to prevent slowing abrasive speed and even stall of the motor during sharpening and provide a wide range of cutting capabilities.

2. Summary of the Prior Art

Numerous self-powered, electric abrasive sharpeners have been developed in the past. Although some past designs produce satisfactory results, the self-powered systems in the prior art are relatively expensive and must rely on the use of numerous precise components for maintain the abrasive element speed to satisfactorily sharpen tools. One convenient and advantageous feature not found in known sharpeners is to provide an economical and effective technique allowing the abrasive cutting element assembly to adapt to the tools being sharpened. Further, in the past the user of a sharpening would experience run-out or slowing of the abrasive elements, due to tools to be sharpened of different sizes, shapes, and amounts of force applied by the tool. Such run-out will, for example, decrease the quality of the sharpened edge of the tool by producing uneven cutting of the tool edge.

SUMMARY OF THE INVENTION

It is therefore an objective of the invention to provide an improved electric sharpener for knives, scissors, and other implements having a flexible adaptable abrasive assembly for a power sharpener for preventing the abrasive assembly from slowing down during sharpening, the effect of which may produce uneven sharpening results or even stalling of the motor. During sharpening the flexible assembly of the invention absorbs forces applied to the abrasive surface such that a detrimental slowdown of the speed of the sharpener is alleviated. This results in an improved sharpening operation in which there is no significant slowing or altogether stopping of the rotation of the abrasive cutting elements due to their shape, size, or the force applied to the abrasive surface, conditions which previously in the prior art interfered with the quality of sharpening of a tool.

BRIEF DESCRIPTION OF THE DRAWINGS

FIG. 5 is an end sectional view, taken along lines 6-6, of FIG. 2;

DESCRIPTION OF THE PREFERRED EMBODIMENT

Figure 1:
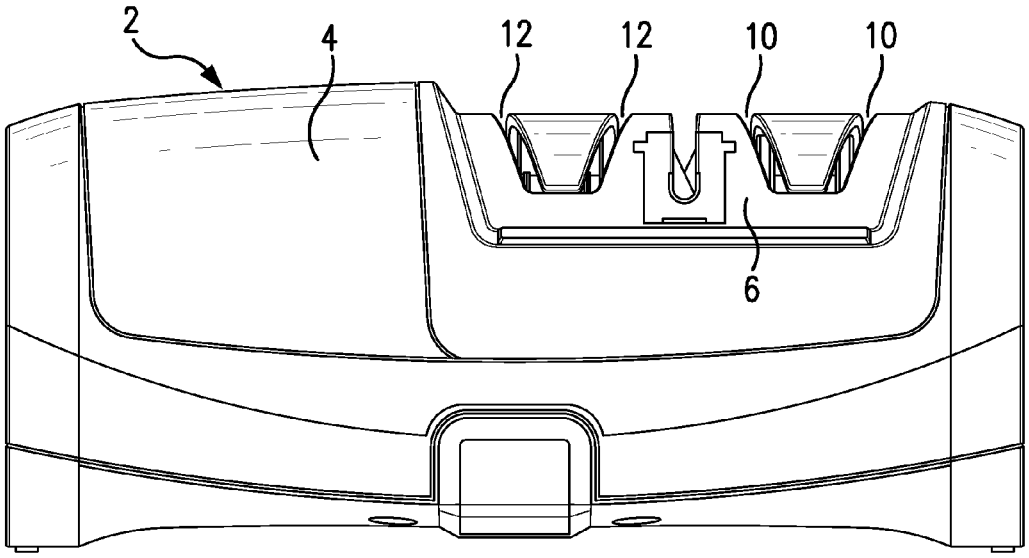
FIG. 1 is a front elevational view of the electric sharpener of the invention.
Figure 2:
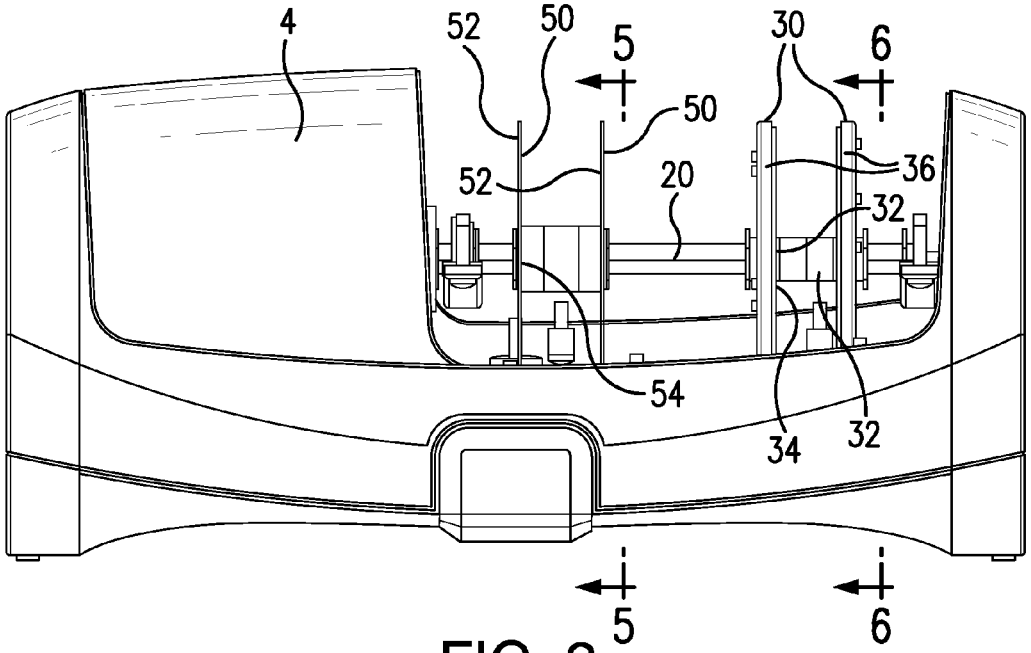
FIG. 2 is a front elevational view, with parts removed, of the electric sharpener of FIG. 1.
Figure 3:
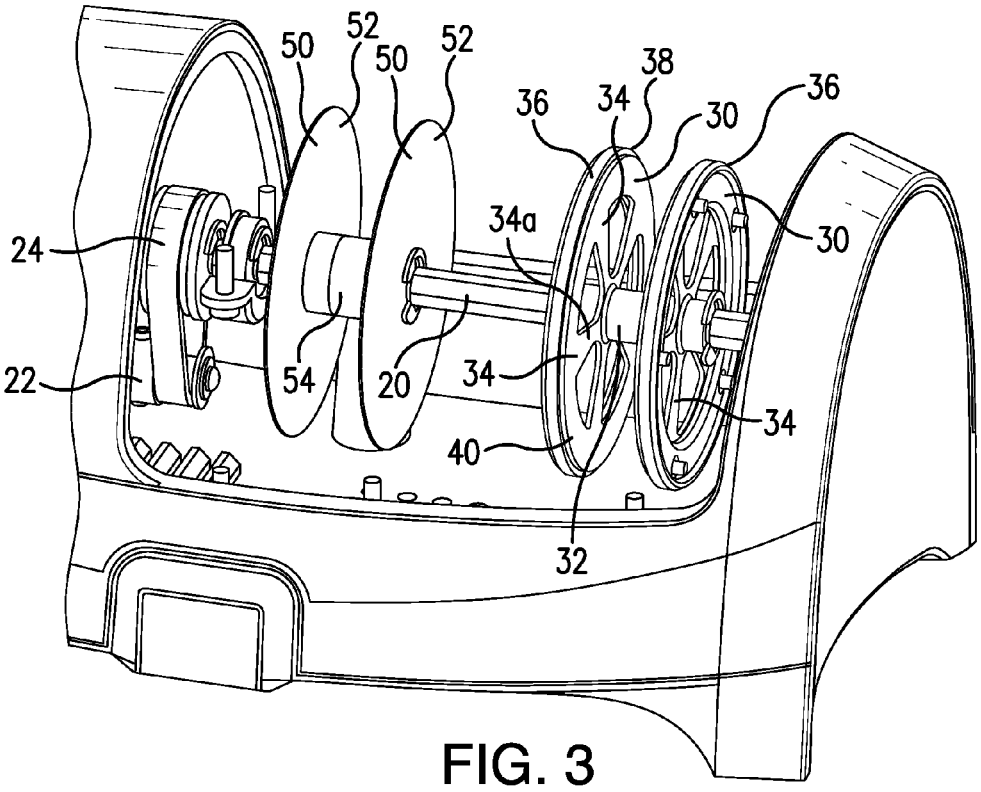
FIG. 3 is a partial side perspective view, with parts removed, of the electric abrasive sharpener of FIG. 1.
Figure 4:
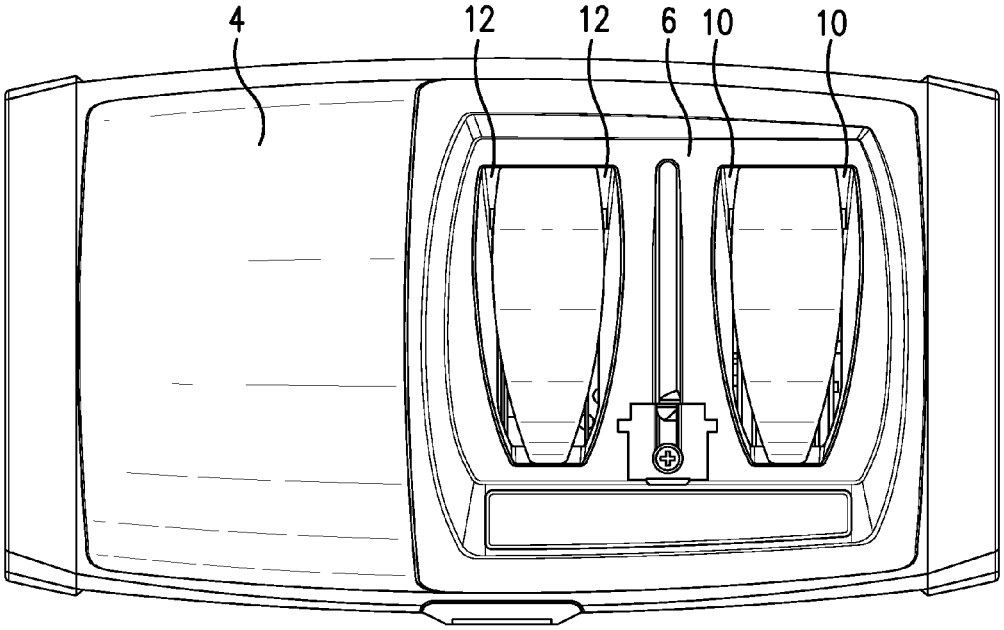
FIG. 4 is a view of the electric abrasive sharpener of FIG. 1.

Referring now to FIGS. 1-6, there is illustrated a self-powered sharpener 2 having a housing 4. A top portion 6 of housing 4 forms a curved enclosure having a first pair of curvilinear slots 10 and a second pair of curvilinear slots 12 which form two respective pairs of adjacent sharpening slots for receiving a variety of implements, such as, for example, knives, scissors, and other tools having edges to be sharpened. As seen in FIGS. 2 and 3, the slots 10 are defined by downward, generally opposed guide surface 10*a*, 10*b* integrally formed on housing top portion 6. Similarly the slots 12 are defined by downward, generally opposed guide surface 12*a*, 12*b* integrally formed on housing top portion 6. The guide surfaces 10*a,b* and 12 *a,b* function to properly align the tool being sharpened adjacent abrasive assemblies to be described.

Figure 5:
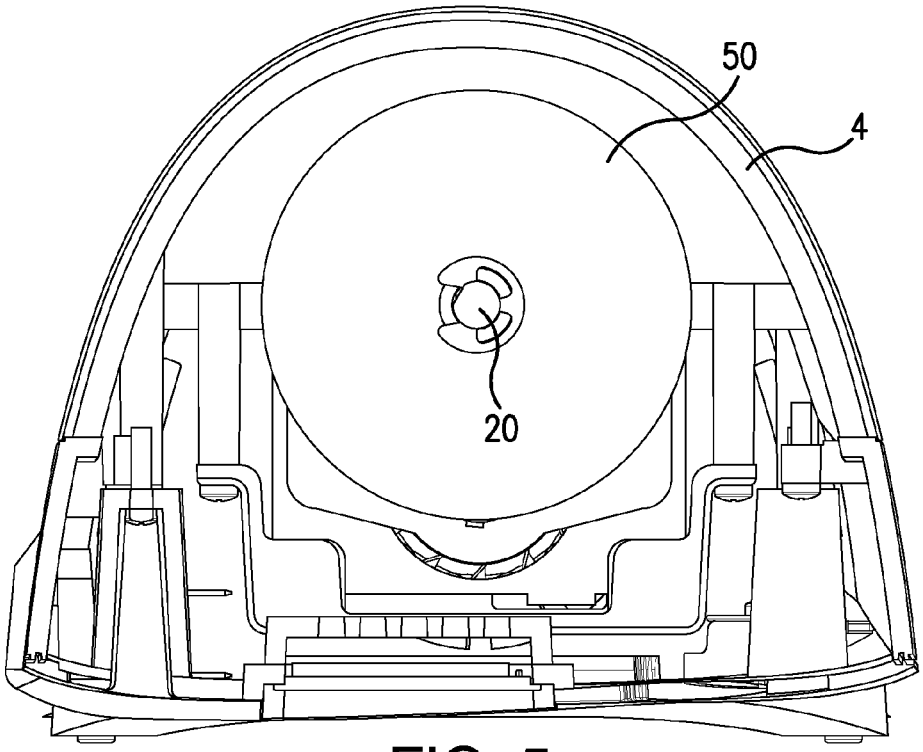
FIG. 5 is an end sectional view, taken along lines 5-5 of FIG. 2.
Figure 6:
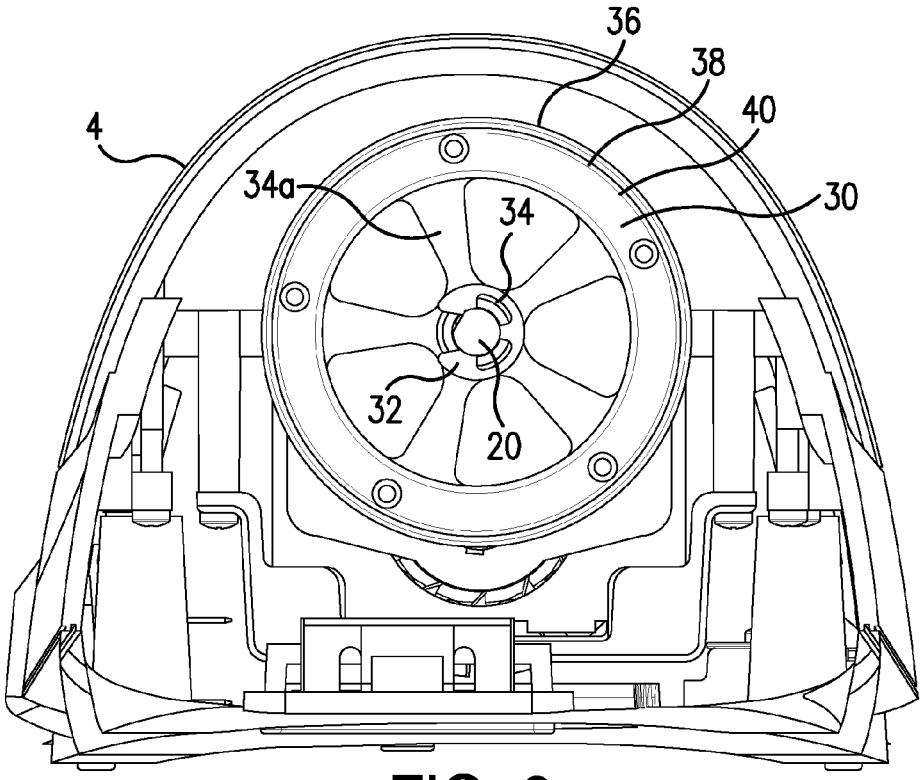
FIG. 6 is

As best seen in FIGS. 2, 3 and 5, a drive shaft 20 is mounted on suitable bushings within the housing 4 for rotation powered by a conventional electric motor 22 through belt connection 24. A pair of abrasive wheel assemblies 30 are rotated by electric motor 22 and are positioned in respective operative alignment with slots 10. The wheel assemblies 30 are mounted on a flexible center hub 32 which is affixed to drive shaft 20. The flexible hub 32 further includes a radially extending center portion 34 comprising a plurality of flexible radial arms 34*a*, such as five in number as shown in FIGS. 2 and 3, that support an outer circumferentially extending, rigid abrasive ring 36. The ring 36 forms a chamfer 38 having a raised continuous rib 40 extending around the shaft, and a suitable abrasive material affixed to rib 40 and chamfer 38. The flexible hub 32 and arms 34*a* can comprise a flexible material, such as ceramic, plastic and other materials that can provide a spring-like energy absorbing properties. The mounting of the wheel assemblies 30 allow the abrasive surface to flex longitudinally relative to the shaft 20 and to rotationally absorb forces exerted by the tool on the abrasive by the user, These forces exerted by the tool being sharpened are not significantly transmitted through the abrasive wheel assemblies 30 to the drive shaft 20 to cause stall of the drive motor and any resulting significant reduction of the speed of the ring 34 to insure optimum sharpening results. The edge of a as a tool being sharpened is positioned in a selective one of slots in contact with the abrasive surfaces formed on abrasive wheel assemblies 30 in angled relationship as defined by sloped guide surfaces 10*a*,10*b*.

Referring now to FIGS. 2, 3 and 5, there is illustrated a second pair of abrasive cutting assemblies 50 using a pair of flat coated abrasive disks 52 which may be formed, for example, by a thin metal and the like and have a coating of an abrasive on their faces and the like for sharpening at the edge of a tool. The flexible flat disk 52 are each affixed on a drive shaft 20 in separated position in attachment to a flexible hub 54, and are also rotated by drive motor 22. The flat coated abrasive disks 52 are aligned with slots 12 to allow the user to guide tools having edges to be sharpened in the correct orientation to abrade the cutting edge against the abrasive flexible flat disks 52. The abrasive disk assemblies 50 function similar to the previously described wheel assemblies 30 by being resiliently deflectable and angularly absorb the forces applied to the abrasive surface by the user during the sharpening operation so that stall of the drive motor prevented and the rotational speed of the abrasive surface is generally maintained for superior results in response to a large range of forces applied by the tool to a respective sharpening disk 52 during sharpening. The pair of wheel assemblies 30 using a flexible center hub 32 and abrasive outer ring 36, and the pair of abrasive cutting surface assemblies 50 using flat coated abrasive disks 52 can be used in tandem or independently

What is claimed is:

1. A self-powered electric sharpener for sharpening the edge of a tool comprising an abrasive wheel assembly being mounted on a powered rotatable shaft, said abrasive wheel assembly having a flexible hub affixed against movement relative to said rotatable shaft, a peripheral abrasive ring operatively connected to said flexible hub by a radially extending, non-abrasive central portion for rotation for sharpening the edge of a tool, an inner portion of said non-abrasive central portion being flexibly affixed to said flexible hub and an outer portion of said non-abrasive central portion being affixed to said to said peripheral abrasive ring, and said flexible hub allowing said inner portion and hence said abrasive ring to deflect relative to the flexible hub by an amount determined by the force applied to said peripheral ring by the tool being sharpened to absorb the force transmitted to said rotatable shaft and to maintain the rotational speed of said rotatable shaft generally constant.

2. The electric sharpener according to claim 1 wherein said central portion includes a plurality of radially extending arms each having said inner portion affixed to said flexible hub said outer portion connected to said abrasive ring.

3. The electric sharpener according to claim 1 wherein said abrasive ring includes an abrasive chamfer having a continuous raised abrasive rib.

4. The electric sharpener according to claim 1 wherein a deformable abrasive disk is further mounted on said rotatable shaft in spaced relation to said abrasive disk assembly, said deformable abrasive disk having at least a peripheral portion being deflected through deformation of said deformable disk by an amount determined by the force of a tool being sharpened to maintain the rotational speed of said rotatable shaft generally constant.

5. A self-powered electric sharpener for sharpening the edge of a tool comprising an abrasive disk assembly being mounted on a powered rotatable shaft, said abrasive disk assembly having a deformable abrasive disk being affixed to said powered rotatable shaft, said disk having at least a peripheral portion for contacting the tool being sharpened, said disk being deformable to cause flexed deflection of at least said peripheral portion of said disk by an amount of deflection being determined by the force applied to said at least peripheral portion of said disk by the tool being sharpened for maintaining the rotational speed of said rotatable shaft generally constant during sharpening.

6. The electric sharpener according to claim 5 wherein said abrasive disk assembly includes an identical pair of said deformable disks.

* * * * *